United States Patent [19]

Schramm

[11] 4,047,508

[45] Sept. 13, 1977

[54] COOLING AIR DISTRIBUTION SYSTEM FOR RECIPROCATING AIRCRAFT ENGINES

[75] Inventor: George R. Schramm, Williamsport, Pa.

[73] Assignee: Avco Corporation, Williamsport, Pa.

[21] Appl. No.: 638,978

[22] Filed: Dec. 8, 1975

[51] Int. Cl.[2] ..... F02F 1/34

[52] U.S. Cl. ..... 123/41.6; 123/41.61; 123/41.62; 123/41.69

[58] Field of Search ..... 123/41.6, 41.69, 41.58, 123/41.61, 41.62; 165/51

[56] References Cited

U.S. PATENT DOCUMENTS

| | | | |
|---|---|---|---|
| 1,429,130 | 9/1922 | Dutton | 123/41.6 |
| 1,783,085 | 11/1930 | Halford | 123/41.6 |
| 1,930,508 | 10/1930 | Conant | 123/41.6 |
| 2,174,418 | 9/1939 | Hersey | 123/41.6 |
| 2,729,201 | 1/1956 | Rohm | 123/41.6 |
| 2,969,781 | 1/1961 | Kolbe | 123/41.69 |
| 2,980,194 | 4/1961 | Porsche | 123/41.6 |
| 3,144,858 | 8/1964 | Horning | 123/41.6 |

*Primary Examiner*—Ronald H. Lazarus
*Assistant Examiner*—Daniel J. O'Connor
*Attorney, Agent, or Firm*—Charles M. Hogan; Irwin P. Garfinkle

[57] ABSTRACT

Disclosed is an improvement in aircraft engines of the opposed piston type comprising cylinders arranged side by side. Cooling efficiency is improved and both average and hot zone temperatures are decreased by an improved air distributor comprising channel and divider members. The channel member is so proportioned and arranged as to admit air in an open mouth near the unfinned portions of adjacent cylinder barrels and to divert some of the barrel zone cooling air to the heads. The divider penetrates substantially into the zone between heads and is offset so that the larger portion of diverted air goes to the hotter head zone.

5 Claims, 12 Drawing Figures

COOLING AIR DISTRIBUTION SYSTEM FOR RECIPROCATING AIRCRAFT ENGINES

BACKGROUND OF THE INVENTION

1. Field of the Invention

The present invention relates to air-cooled reciprocating engines and, more specifically, comprises improvements in systems for distributing cooling air to the exterior surfaces of the cylinder assemblies of such engines.

2. Description of the Prior Art

The assignee of the present application and invention is an established manufacturer of opposed-piston air-cooled reciprocating aircraft engines of the type illustrated in its U.S. Pat. No. 2,729,201 to F. G. Rohm, issued Jan. 3, 1956. The improvements provided by the present invention have in common with the prior art the provision of cooling fins, formed for the most part in groups and in a generally circumferential or peripheral manner about the barrel and head of each cylinder assembly.

The superior cooling characteristics of an engine in accordance with the invention are achieved primarily by the construction and positioning of a cooling air distributor which represents a substantial improvement over that shown in the above-mentioned U.S. patent.

SUMMARY OF THE INVENTION

The preferred embodiment of the invention comprises a combination of improved air distributor and a wide fin root, which combination materially decreases the cooling air drag on a reciprocating engine of the opposed-piston type.

A primary object of the invention is to provide an improved cooling air distributor and cylinder arrangement which functions in such a manner to equalize head zone temperatures and provide a more uniformly cooled head.

Another object of the invention is to provide an air distributor with an offset divider so arranged that the greater portion of the cooling air which it directs to the head is deflected toward an exhaust port, thereby to maximize temperature equalizing effect.

A further object of the invention is to provide an improved air distributor which lowers both average head temperature and hot zone head temperature and increases cooling efficiency.

BRIEF DESCRIPTION OF THE DRAWINGS

For a better understanding of the invention, together with other and further objects, advantages and capabilities thereof, reference is made to the following description of the appended drawings in which.

DETAILED DESCRIPTION OF THE INVENTION

Figure 9:
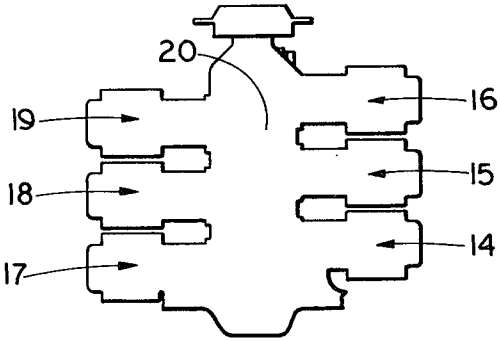
FIG. 9 is a top plan outline skeleton view of a reciprocating engine in which the invention is incorporated.
Figure 10:
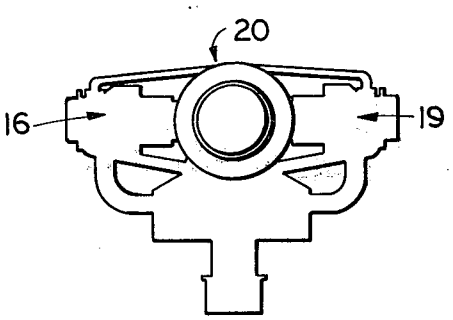
FIG. 10 is a front end elevational view of the engine of FIG. 9.

The invention is of particular utility as incorporated in a reciprocating engine of the opposed-piston type, as illustrated in skeleton outline form in FIGS. 9 and 10. Such an engine comprises cylinder assemblies 14, 15, 16, 17, 18 and 19, suitably assembled in relation to a central crankcase housing 20.

Figure 1:
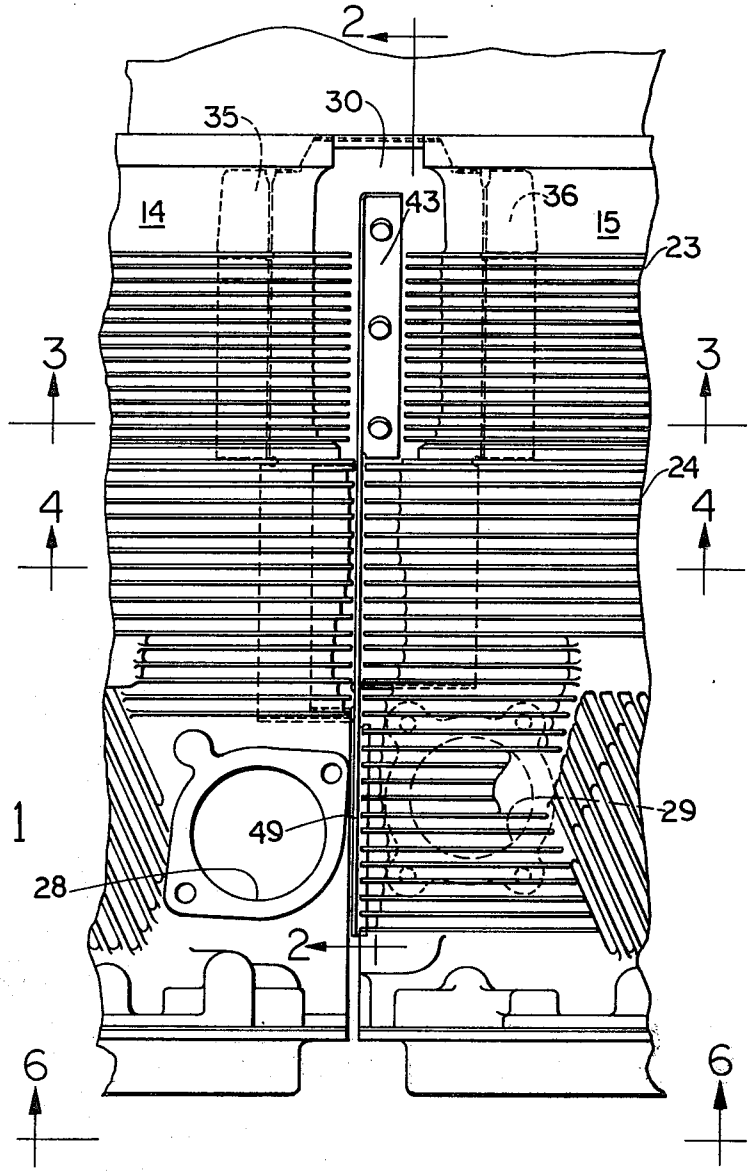
FIG. 1 is a top plan view of the barrel and head portion of an improved opposed-piston reciprocating engine in accordance with the invention, showing fragments of two adjacent cylinder barrels and cylinder heads, including my novel and featured air current distributor, the channel of the distributor being positioned under and between cylinders, the cylinders being shown in horizontal operating position.

Now directing attention specifically to FIG. 1, there are shown portions of typical cylinders such as those designated 14 and 15. Each cylinder comprises a barrel 21 and a head portion 22. It will be understood that a piston reciprocates within each barrel and each head houses a combustion chamber. Each barrel is formed with a plurality of annular or circumferentially arranged parallel heat dissipating fins, such as that designated 23, and each head incorporates a plurality of fins 24. The barrel fins are conventional. Preferably, the head fins have a width dimension of approximately 0.12 inch and a depth which varies, the greater depth being used at the hotter sections of the head. The stops 35 and 36 prevent cooling air leakage around the unfinned portions of the barrels. The cylinders are cooled by passing cooling air over the groups of fins represented by elements 23 and 24, with the aid of my improved circulation distributor, designated by the general reference numeral 25 and illustrated in perspective in FIG. 7. The dimension of 0.12 inch, mentioned above, is the width of a representative head fin root.

Figure 7:
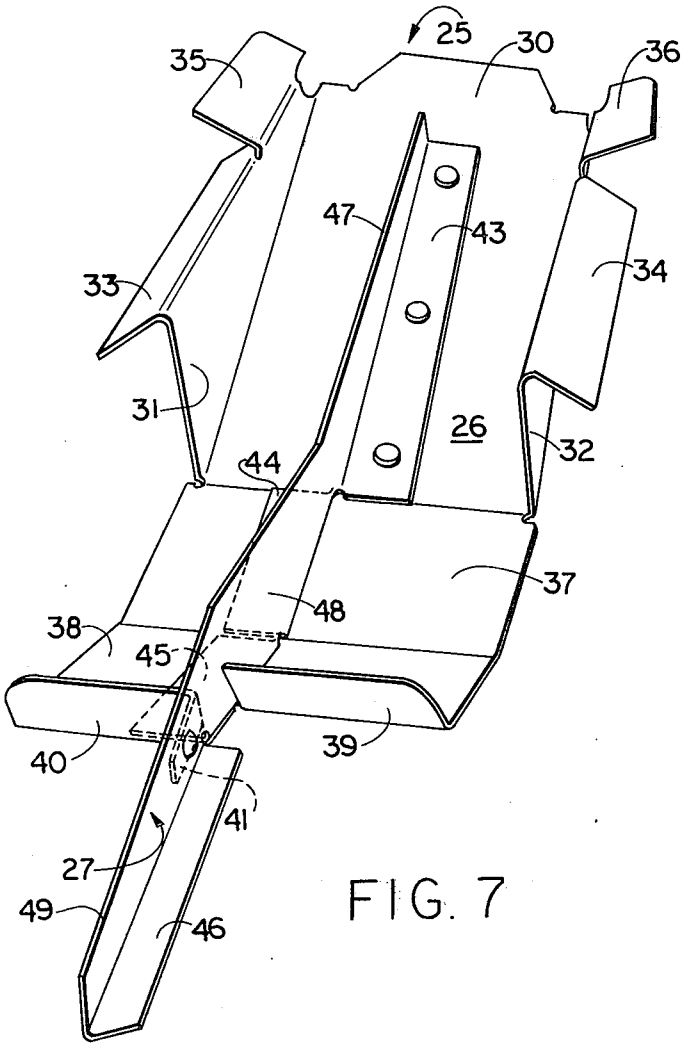
FIG. 7 is a perspective view of the air current distributor which is featured in accordance with the invention, including a main channel element and a divider.
Figure 12:
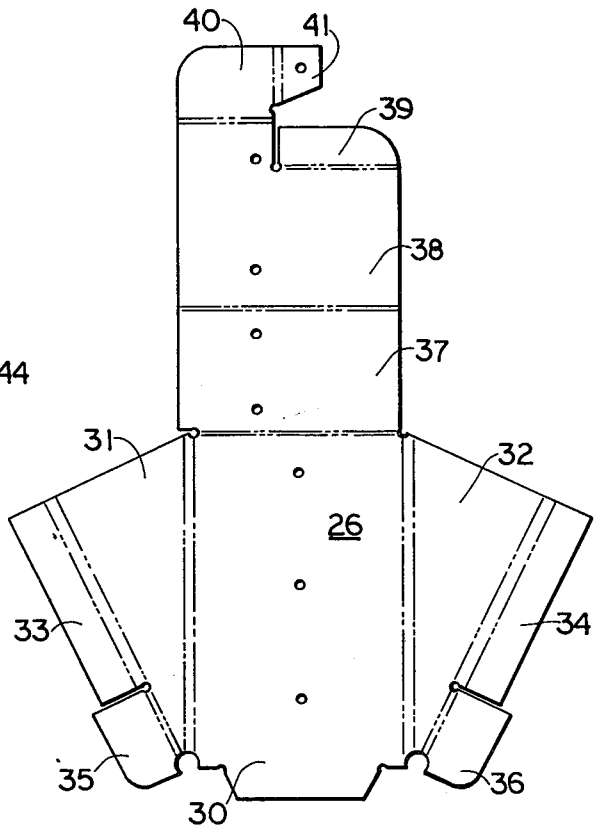
FIGS. 11 and 12 are planar developments of the channel and divider members, respectively, of the FIG. 8 cooling air distributor.
Figure 11:
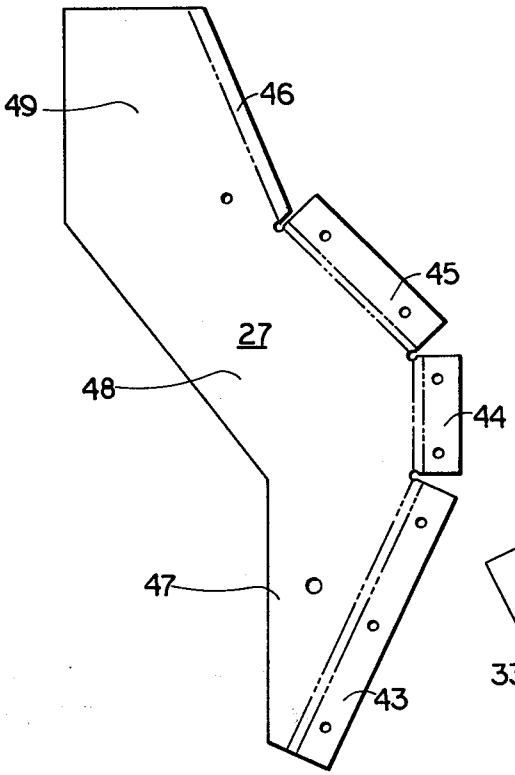

Referring now specifically to FIGS. 2, 7, 8, 11 and 12, and particularly to FIG. 7, it will be seen that the effective plane of the divider 27 is at right angles to, although slightly offset from, the central longitudinal section of the channel member 26. The runner of the channel member 26 comprises a first generally flat section 30 from which transversely project, at right angles, generally triangularly shaped wings 31 and 32, the apex of each wing extending in the direction of the base of the cylinder. These wings terminate in bent-back flaps 33 and 34, respectively, the flaps being proportioned closely to underlie adjacent barrels (FIG. 3), the flaps being cut to provide stops 35 and 36, which abut against end flanges of the barrels to aid in holding the circulation distributor in place. The runner section 30 is at an angle relative to the cylinder axis and slopes away from the barrel, per FIG. 2. The barrel section 30 of the channel member 26 is integral with the first head-contour following section 37 and the second head-contour following section 38, the section 37 being obliquely angularly disposed relative to the section 30 and section 38 being angularly obliquely disposed relative to the section 37. Sections 30, 37 and 38 are portions of the runner. The left-hand portion of the section 38 is slightly longer than the right-hand portion (FIG. 7). The two sides of section 38 terminate in flaps 39 and 40 and flap 40 in turn terminates in a lug 41, rigidly secured to portion 49 of divider 27.

Referring now to the divider member 27, it is formed with three integral transversely extending tabs 43 (secured to 30), 44 (secured to 37), and 45 (secured to 38). Portion 49 of divider 27 has an integral positioning flap 46 which stiffens the divider.

Figure 4:
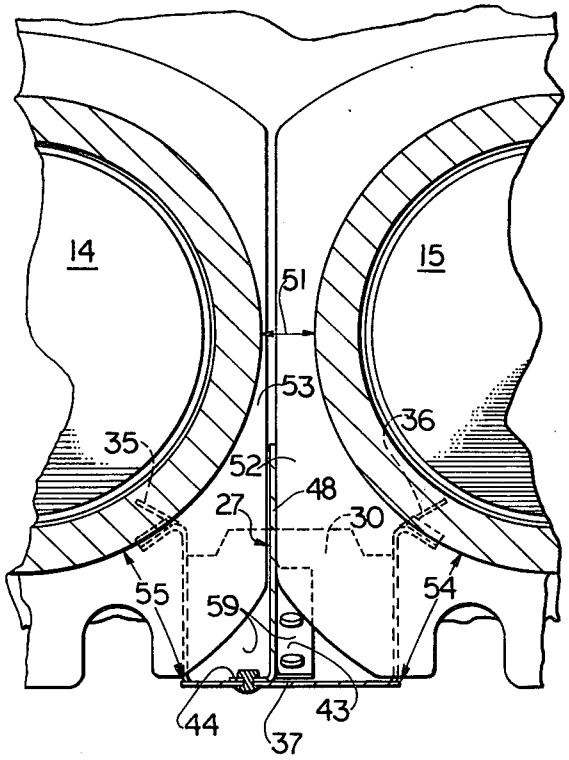
FIGS. 3 and 4 are, respectively, sectional views taken in planes transverse to the longitudinal axes of the distributor, barrel and head combinations of FIG. 1 and looking in the directions of the pairs of arrows 3—3 and 4—4, respectively.
Figure 3:
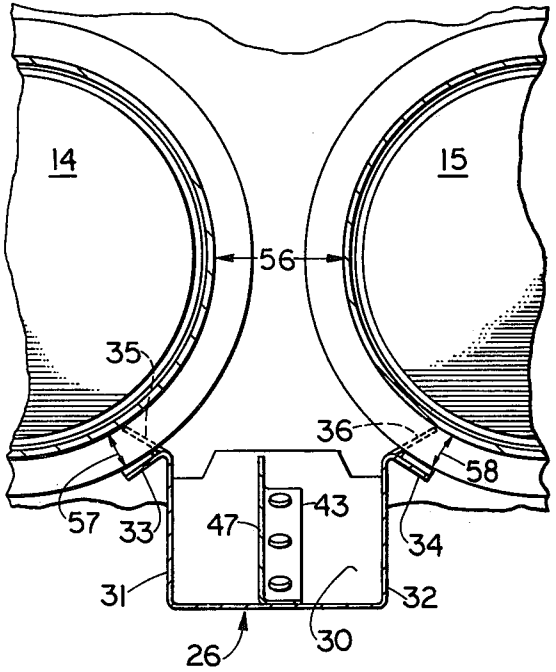
Figure 6:
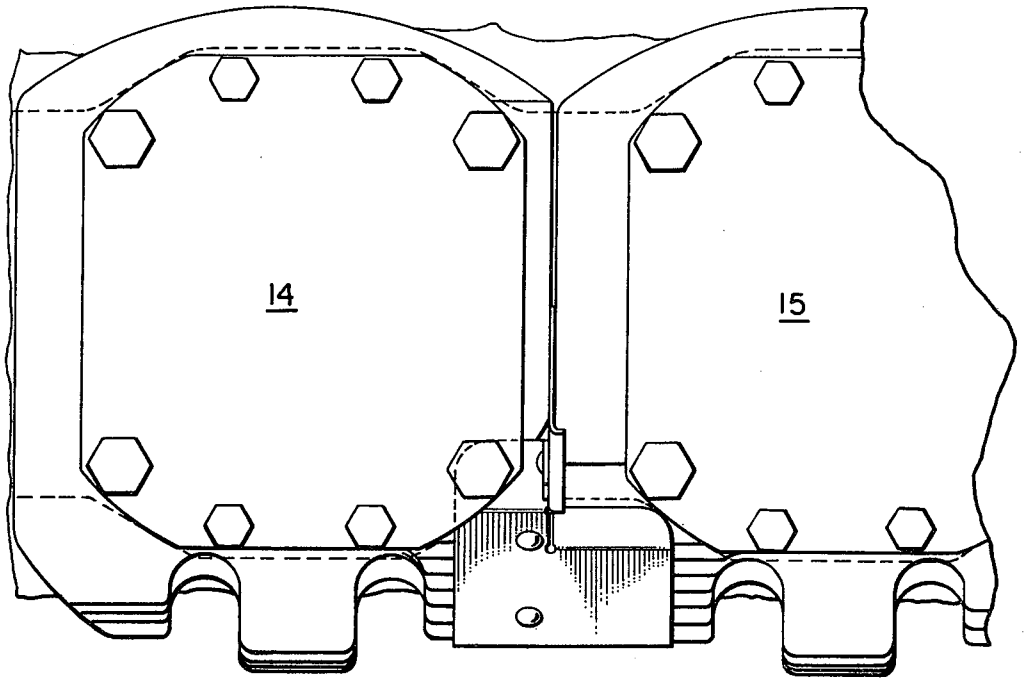
FIG. 6 is an end elevational view looking into the heads of the FIG. 1 combination, the viewing line being that indicated by the arrows of the line 6—6 of FIG. 1.
Figure 5:
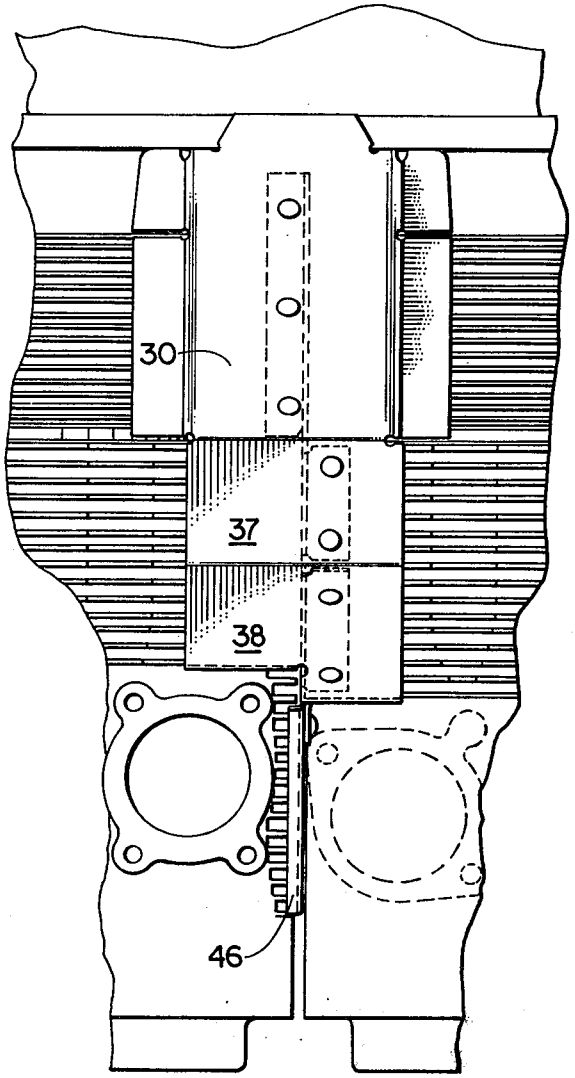
FIG. 5 is a bottom-plan view of the combination of FIG. 1.
Figure 8:
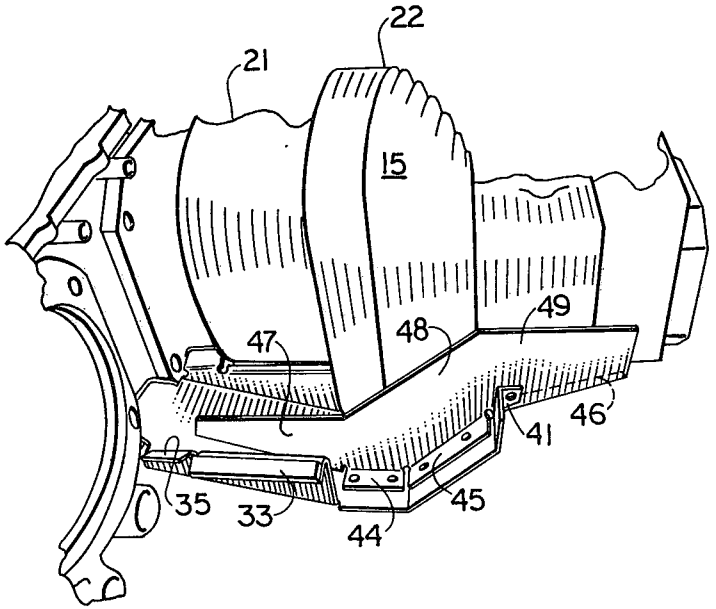
FIG. 8 is a fragmentary side perspective view of a typical cylinder head, barrel and distributor element in accordance with the invention.

The main body of the divider 27 comprises a triangular partition 47 which fairly conforms in slope to the wings 31 and 32 but begins at a point spaced from the inner edge of section 30. This partition 47 projects into the zone between two adjacent barrels, as shown in FIG. 3. In continuity with triangular partition 47 is an upwardly and outwardly extending partition 48 which extends into the zone between adjacent heads, as shown in FIG. 4. In continuity with partition 48 is a generally outwardly extending integral partition 49. Partitions 48 and 49 constitute a fin. The construction of the runner is such that the slopes of sections 37 and 38 generally follow the contours of the cap-like and bulging head. The shape of partition 48 is such as to penetrate fairly uniformly through the inner portions of the head. The outer portions of the head are of relatively smaller periphery so that partition 49 of divider 17 projects outwardly. The expressions "inner" or "inwardly" as used in this paragraph are intended to relate to the base of a cylinder or central axis of the engine. Progressing from this central axis outwardly are the barrel, the larger peripheral portions of the head, and the smaller peripheral portions of the head. In the normal operating position of the engine the partition 49 is a vertical plane and its top edge extends in substantially a horizontal direction, as also do flaps 33 and 34 and the top edge of partition 47.

Figure 2:
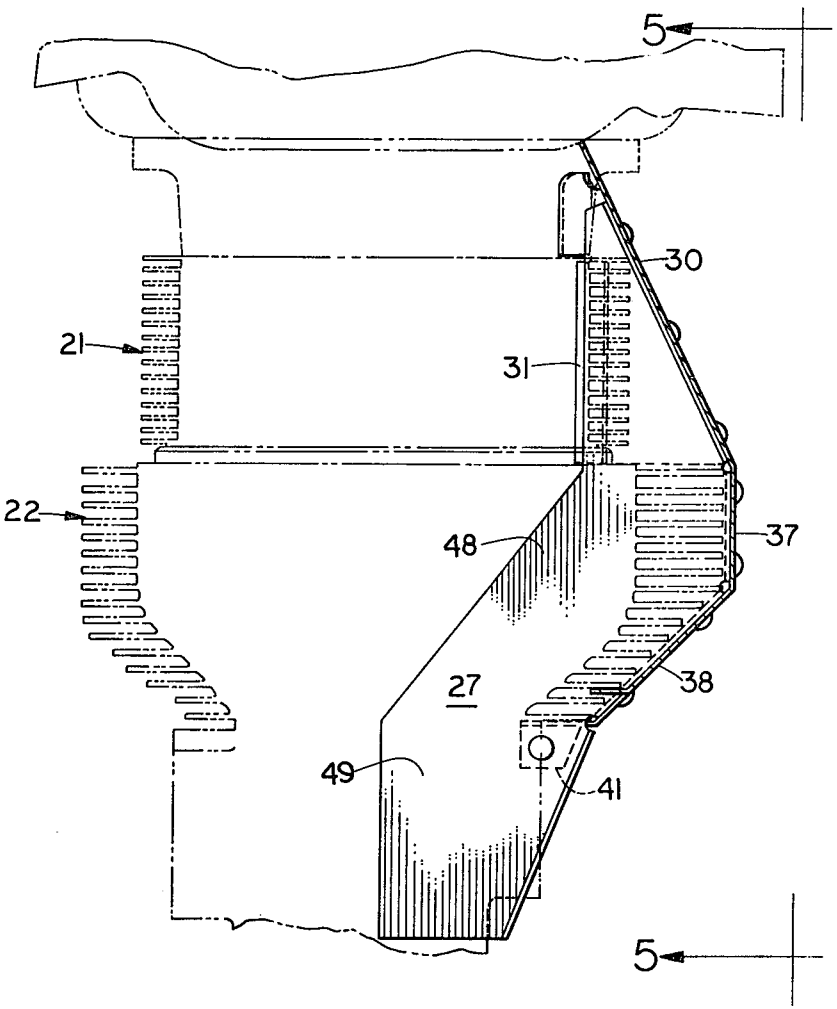
FIG. 2 is a longitudinal sectional view of the FIG. 1 barrel, head and distributor structure, as taken along a section line 2—2 of FIG. 1 and looking in the direction of the arrows.

In the cooling air distributing system of the prior art Rohm U.S. Pat. No. 2,729,201 there was an element referred to as a horizontal divider and also an element referred to as a base plate, these being disposed transversely to and generally along the axial direction of the distributor and numbered 23 and 22, respectively, in that patent. These elements were placed in the vicinity of the bases of the cylinder barrels for the purpose of preventing the passage of cooling air between the base or unfinned portions of the cylinders. By contrast, these elements are omitted in accordance with the present invention and air passing along the unfinned portions is caught and usefully employed as a supplement to that taken from between the finned sections of the barrels. As seen in FIGS. 2 and 3, the inner portions of the barrels are unfinned. Cooling air is admitted via the open mouth formed by the leading edge of runner portion 30 and such unfinned portions. The area between the head fins of adjacent heads and the channel member is increased by making the channel member section 37 flat, as best illustrated in FIG. 4. A representative entrance orifice for cooling air is noted at 51 in FIG. 4. Cool air flows along the surfaces of representative fins 52 and 53. The exit orifices are 54 and 55.

In operation, air from the aircraft cowl enters the finned portions of the cylinder heads through the air-admitting orifices 51. The entrance orifices 51 are restrictive compared to the head-zone exit orifices 54 and 55 as shown in FIG. 4. Cooling air also enters the finned portions between the cylinder barrels via the admitting orifices represented by 56 which greatly exceed in area the barrel-zone exit orifices 57 and 58 per FIG. 3 so that the channel member 26 routes excess air from the barrel section to the head section via the generally triangular passage 59 (FIG. 4), and this air finally exits via orifices 54 and 55 in supplement to the air coming through the orifices represented by 51. Orifices 54 and 55 are wide because section 37 is flat. The effect is substantially to increase the cooling effectiveness of the head fins. Since the lower two quadrants of the head are generally hotter than the others, the additional cooling here tends to equalize the temperature and to provide a more uniformly cooled head.

Reiterating, the relative sizes of barrel entrance orifices 56 and pairs of exit orifices 57 and 58 are such that some of the exit air is forced toward the head via the channel member 26 and this air moves along passage 59 and cools the head fins, finally emerging through orifices 54 and 55 together with the cooling air admitted through orifices 51.

The divider member 26 is not centrally located with respect to the two adjacent cylinders, as clearly appears in FIGS. 3, 4, 7 and 12. The divider member is offset from the central line through the channel member in such fashion as to be more proximate to the neighboring cylinder 14 which has an adjacent intake port 28. Thus, the greater share of the cooling air is directed to the head quadrant which contains the exhaust port 29. This is the hottest zone and the temperature equalizing effect is accordingly maximized. The divider 27 of the present invention not only serves to stiffen the cooling air distributing structure but it also prevents the escape of cooling air from the exhaust side fins to the intake side fins.

The invention provides:

In a reciprocating engine of the type including at least two cylinders 14 and 15 disposed side by side, each cylinder comprising a barrel 21 and an enlarged head 22 of bulging caplike contour, the barrel and the head being formed with groups of peripheral cooling fins 23 and 24, a cooling air distributor 25 comprising a channel portion 26 and a divider portion 27, the channel portion being formed with a runner 30, 37, 38, 39, 40 and triangularly shaped wings 31, 32, transverse to the runner and terminating in flaps 33, 34, the flaps being positioned closely adjacent the barrels and the runner forming an open mouth and next conforming first (by the slope of 30) to the triangular wings and second (by sections 37, 38) to the bulging caplike head in the progression from the inner region of the barrel to the outer region of the head, the barrel-zone admitting orifices 56 of cooling air being large with respect to the flap-barrel spacing which defines barrel-zone exit orifices 57, 58, the runner continuing substantially (per 37, 38, 39, 40) beyond the termination of the triangular wings and being formed so that its side edges are disposed to provide head-zone exit orifices 54, 55, that are large with respect to the head-zone admitting orifices 51, whereby part of the cooling air admitted via said open mouth and the barrel-zone admitting orifices is diverted from the barrels to the heads, the divider being transverse to the channel portion and being formed with a triangular portion 47 generally conforming to the wings and with a fin 48, 39 which substantially penetrates into the zone between heads.

The invention also provides:

In a reciprocating engine, the combination of a pair of juxtaposed cylinders 14, 15, each cylinder comprising a barrel 21 and a head 22, the barrels and heads being formed with groups of peripheral cooling fins 23, 24, one of said heads having an intake port 28 proximate to the space between them and the other of said heads having an exhaust port 29 proximate to the space between them, and a cooling air distributor 25 comprising a divider portion 27 and a channel portion 26, the channel portion 26 being formed and positioned in such manner as to divert cooling air from the barrels to the heads, the divider portion 27 being transverse to the channel portion and projecting into the space between the heads and particularly (as at 49) into that portion of the space between said ports, the divider portion being offset (per FIG. 1) relative to the channel portion toward said intake port 28 so that the majority of the diverted air passes to the head with the proximate exhaust port.

While there has been shown and described what is at present considered to be the preferred embodiment of the invention, it will be obvious to those skilled in the art that various changes and modifications may be made therein without departing from the true scope of the invention as defined in the appended claims.

Having disclosed my invention, I claim:

1. In a reciprocating engine of the type including at least two cylinders disposed side by side, each cylinder comprising a barrel and an enlarged head of bulging caplike contour, the barrel and the head being formed with groups of peripheral cooling fins, a cooling air distributor comprising a channel portion and a divider portion, the channel portion being formed with a runner and triangularly shaped wings transverse to the runner and terminating in flaps, the flaps being positioned closely adjacent the barrels and the runner forming an open mouth and next conforming first to the triangular wings and second to the bulging caplike head in the progression from the inner region of the barrel to the outer region of the head, the barrel-zone admitting orifices of cooling air being large with respect to the flap-barrel spacing which defines barrel-zone exit orifices, whereby part of the cooling air admitting via said open mouth and the barrel-zone admitting orifices is diverted from the barrels to the heads, the runner continuing substantially beyond the termination of the triangular wings and being formed so that its side edges are disposed to provide head-zone exit orifices that are large with respect to the head-zone admitting orifices, the divider being transverse to the channel portion and being formed with a triangular portion generally conforming to the wings and with a fin which substantially penetrates into the zone between heads.

2. In a reciprocating engine, the combination of a pair of juxtaposed cylinders, each cylinder comprising a barrel and a head, the barrels and heads being formed with groups of peripheral cooling fins, one of said heads having an intake port proximate to the space between them and the other of said heads having an exhaust port proximate to the space between them, and a cooling air distributor comprising a divider portion and a channel portion, the channel portion being formed and positioned in such manner as to divert cooling air from the barrels to the heads, the divider portion being transverse to the channel portion and projecting into the space between the heads and particularly into that portion of the space between said ports, the divider portion being offset relative to the channel portion toward said intake port so that the majority of the diverted air passes to the head with the proximate exhaust port.

3. In a reciprocating engine, the combination of:

at least two cylinders disposed side by side, each cylinder comprising a barrel and an enlarged head of bulging caplike contour, the barrel and the head being formed with groups of peripheral cooling fins, and a cooling air distributor comprising a channel portion and a divider portion, the channel portion being formed with a runner and triangularly shaped wings transverse to the runner and terminating in flaps, the flaps being positioned closely adjacent the barrels and the runner forming an open mouth and next conforming first to the triangular wings and second to the bulging caplike head in the progression from the inner region of the barrel to the outer region of the head, the barrel-zone admitting orifices of cooling air being large with respect to the flap-barrel spacing which defines barrel-zone exit orifices, whereby part of the cooling air admitted via said open mouth and the barrel-zone admitting orifices is diverted from the barrels to the heads, the runner continuing substantially beyond the termination of the triangular wings and being formed so that its side edges are disposed to provide head-zone exit orifices that are large with respect to the head-zone admitting orifices, the divider being transverse to the channel portion and being formed with a triangular portion generally conforming to the wings and with a fin which substantially penetrates into the zone between heads.

4. A cooling air distributor for a reciprocating engine of the type including at least two horizontally positioned cylinders disposed side by side, each cylinder comprising a barrel and an enlarged head, the barrel and the head being formed with groups of peripheral cooling fins, said distributor comprising, in combination:

a channel member and a divider member, the channel member being formed with a runner, the runner having near its one end transverse sloping wings terminating in flaps, the flaps forming acute angles with the wings and adapted to be positioned closely adjacent the barrels and the runner being adapted to form an open mouth between the flaps and being shaped to conform first by an outwardly sloping section to the wings, and second, by a flat section parallel to the cylinder axis and an inwardly sloping flat section, to conform to the head in the progression from the inner region of the barrel to the outer region of the head and toward the outer end of the runner, the runner continuing substantially beyond the termination of the wings and being formed so that side edge portions of a flat section are adapted to be positioned to provide head-zone exit orifices, the divider being positioned transverse to the channel member and being formed with a first triangular portion, which rises near one of the fin ends in conformity to the slope of the wings, and a fin portion which has a head-zone penetrating edge extending substantially into the zone between heads.

5. A cooling air distributor for a reciprocating engine of the type including at least two horizontally positioned cylinders disposed side by side, each cylinder comprising a barrel and a head, the barrel and the head being formed with groups of peripheral cooling fins, the cooling air-admitting orifices between heads being small compared to the air-admitting orifices between barrels, said cooling air distributor comprising, in combination:

a channel portion and a divider portion, the channel portion being formed with a runner and the runner having near its one end triangularly shaped wings transverse to the runner and terminating in flaps, the flaps forming acute angles with the wings and adapted to be positioned closely adjacent the barrels and the runner being adapted to form an open mouth between the flaps and being shaped to conform first by an outwardly sloping section to the triangular wings and second, by a flat section parallel to the cylinder axis and then an inwardly sloping section to conform to the head in the progression from the inner region of the barrel to the outer region of the head and toward the other end of the runner, the distributor and cylinders being positioned to form barrel-zone exit orifices small with respect to the barrel-zone admitting orifices, whereby part of the cooling air admitted via said open mouth and the barrel-zone admitting orifices is diverted from the barrels to the heads, the runner continuing substantially beyond the termination of the triangular wings and being formed so that the side edges of a flat section are adapted to be positioned adjacent the heads to provide head-zone exit orifices large with respect to the head-zone admitting orifices between the heads, the divider portion being disposed transverse to the channel portion and being formed with a first triangular portion, which rises near one of the fin ends in conformity to the wings, and a second portion which has a head-zone penetrating edge extending substantially into the zone between heads.

* * * * *

UNITED STATES PATENT OFFICE

CERTIFICATE OF CORRECTION

PATENT NO. 4,047,508

DATED September 13, 1977

INVENTOR(S) George R. Schramm

It is certified that error appears in the above-identified patent and that said Letters Patent are hereby corrected as shown below:

Col. 6, line 3 (Claim 2, line 11), after "heads," insert --

-- the channel portion being formed with a runner having at one end wings terminating in flaps which cooperate with the barrels to form barrel zone exit orifices small with respect to the admitting orifices between the barrels, the runner further being formed at its other end with a flat section cooperating with the heads to form head zone exit orifices large with respect to the admitting orifices between the heads, -- .

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*